United States Patent [19]

Kazama et al.

[11] 4,343,619

[45] Aug. 10, 1982

[54] METHOD OF PREPARING A SCOURED ANIMAL HAIR MATERIAL

[75] Inventors: Ken Kazama, Kamakura; Ikuo Muramoto, Yokohama; Kenji Ozaki, Gifu; Yoshinobu Kusunoki, Kyoto, all of Japan

[73] Assignees: Asahi-Dow Limited, Tokyo; Toa Wool Spinning & Weaving Co., Ltd., Osaka, both of Japan

[21] Appl. No.: 247,146

[22] Filed: Mar. 24, 1981

Related U.S. Application Data

[63] Continuation-in-part of Ser. No. 134,321, Mar. 26, 1980, abandoned.

[30] Foreign Application Priority Data

Mar. 30, 1979 [JP] Japan ..... 54-37915
Mar. 30, 1979 [JP] Japan ..... 54-37916

[51] Int. Cl.[3] ..... D01C 1/00

[52] U.S. Cl. ..... 8/139; 8/139.1; 8/150.5; 8/159

[58] Field of Search ..... 8/139, 139.1, 142, 150.5, 8/159

[56] References Cited

U.S. PATENT DOCUMENTS

| | | | |
|---|---|---|---|
| 3,600,124 | 8/1971 | Couche | 8/139.1 |
| 3,619,116 | 11/1971 | Saville | 8/139.1 |
| 4,082,508 | 4/1978 | Marshall | 8/139.1 |
| 4,168,143 | 9/1979 | Wood | 8/139 |

FOREIGN PATENT DOCUMENTS

| | | |
|---|---|---|
| 2111632 | 9/1972 | Fed. Rep. of Germany . |
| 53/74178 | 7/1978 | Japan . |
| 241314 | 10/1925 | United Kingdom . |
| 668467 | 3/1952 | United Kingdom . |
| 835502 | 5/1960 | United Kingdom . |
| 1080440 | 8/1967 | United Kingdom . |
| 1200105 | 7/1970 | United Kingdom . |
| 1219514 | 1/1971 | United Kingdom . |

*Primary Examiner*—A. Lionel Clingman
*Attorney, Agent, or Firm*—Armstrong, Nikaido, Marmelstein & Kubovcik

[57] ABSTRACT

A new type of scoured animal hair material, in which the animal hair retains therein 1 to 3% by weight of a residual soapy substance and 0.3 to 5% by weight of a residual fatty substance, is prepared by scouring a greasy animal hair material in the form of opened loose fibers having a density of 0.007 to 0.04 g/cm$^3$, with a scouring liquid comprising at least one organic solvent selected from 1,1,1-trichloroethane and methylene chloride and 0.1 to 10%, based on the weight of the scouring liquid, of a raw animal hair grease which has been extracted from the same type of greasy animal hair as that to be scoured, while moving either one or both of the animal hair material and the scouring liquid in relation to each other at a relative speed of 3 to 60 m/min.

8 Claims, 8 Drawing Figures

METHOD OF PREPARING A SCOURED ANIMAL HAIR MATERIAL

This application is a continuation-in-part of patent application Ser. No. 134,321, filed on Mar. 26, 1980, now abandoned.

FIELD OF THE INVENTION

The present invention relates to a method for preparing a scoured animal hair material. More particularly, the present invention relates to a method for preparing a scoured animal hair material retaining therein proper amounts of residual soapy and fatty substances.

BACKGROUND OF THE INVENTION

The term "soapy substance" as used herein refers to a substance which is naturally retained in greasy animal hair and which can be extracted from the animal hair by using ethyl alcohol. The content of the soapy substance in the scoured animal hair can be determined by measuring the absolute dry weight of the scoured animal hair and the weight of the soapy substance extracted from the scoured animal hair with ethyl alcohol in accordance with a method set forth in paragraph 7, 8, 2, of Japanese Industrial Standard L 1022-1961, and is expressed by a ratio (in %) of the measured weight of the soapy substance to the absolute dry weight of the scoured animal hair.

The term "fatty substance" as used herein refers to a substance which is naturally retained in greasy animal hair and which can be extracted from the animal hair by using ethyl ether. The content of the fatty substance in the scoured animal hair can be determined by measuring the absolute dry weight of the scoured animal hair and the weight of the fatty substance extracted from the scoured animal hair by ethyl ether in accordance with the method set forth in paragraph 7, 8, 1 of Japanese Industrial Standard (JIS) L 1022-1961, and is expressed by a ratio (in % ) of the measured weight of the fatty substance to the absolute dry weight of the scoured animal hair.

It is known that greasy animal hair, such as greasy wool, is usually scoured with an aqueous scouring solution of a detergent, which contains a surface active agent and an alkali or alkaline salt, at an elevated temperature. This method is referred to hereinafter as a detergent-scouring method for animal hair. This detergent-scouring method is effective for eliminating not only the fatty substance, but also, the soapy substance from the animal hair material. However, this method is disadvantageous in the following points.

(1) Sometimes, the surface property and mechanical strength of the animal hair are deteriorated by the action of the alkali or alkaline salt in the scouring solution.

(2) Sometimes, the animal hair fibers are entangled with each other so as to form a felt during the scouring operation. (3) The scoured animal hair exhibits a decreased elasticity and stretchability. (4) The scoured animal hair exhibits poor carding and spinning properties. This feature causes the efficiency in production of animal hair yarn to be poor.

(5) A waste water having an extremely offensive door is discharged in a large amount from the scouring process, and causes the environment (rivers, lakes and seas) to be polluted therewith.

(6) The clarifying process for the discharged water waste is expensive.

(7) Consumption of heat energy is large.

It is also known that various approaches were looked into for eliminating the above-mentioned disadvantages of the detergent-scouring method. That is, the C.S.I.R.O. method (Wool Handbook, Interscience Publishers, Vol. II, Part 1 (1969) pages 71 through 74), Centri wool method (Wool Handbook, Vol. II, Part 1 (1969), pages 74 to 76), Sover method (Japanese Patent Application Publication (Kokoku) No. 38-10374) and a method of Japanese Patent Application Laid-open (Kokai) No. 53-74178, as well as a method disclosed in Textile Asia, pages 23 to 25 (September, 1971) used as organic solvent for scouring the greasy animal hair, especially, greasy wool.

This type of scouring method is referred to hereinafter as a solvent-scouring method. In the solvent-scouring method, the organic solvent is recovered from the scouring liquid waste. Therefore, substantially no scouring liquid is discharged from the solvent-scouring process. This feature results in substantially no environmental pollution.

However, the solvent scouring method has not yet been practically utilized in industry due to the following disadvantages.

(1) The effect of this method is unsatisfactory in the elimination of solid inorganic materials, for example, small particles of sand, and water-soluble substances from the greasy animal hair. This feature results in a poor brightness, and poor carding and spinning properties of the scoured animal hair. Also, the residual fatty substance is unevenly distributed on the surface of the animal hair. Therefore, in order to eliminate the above-mentioned disadvantages, it is necessary that the solvent-scouring process be followed by an additional washing process with hot water or an aqueous detergent solution for removing the solid inorganic particles from the scoured animal hair. This necessity causes the total cost of the preparation of scoured animal hair to be high.

(2) The effect of this method is excessive in the elimination of the fatty substance from the greasy animal hair. This feature causes the resultant scoured animal hair to exhibit a poor softness, a coarse touch and a poor adhering property of the hairs to each other.

A modified solvent-scouring method is disclosed by Japanese Patent Application Publication (Kokoku) No. 38-10374. In this method, a mass of greasy wool is opened, and the opened greasy wool is washed with water, and then, scoured with a non-alcohol type organic solvent. A combination of the above-mentioned washing and scouring operations is repeated twice or more, and an operation for scouring the animal hair with an alcohol is inserted between the combinations of the above-mentioned washing and scouring operations. However, this method is unsatisfactory in completely eliminating the disadvantages of the conventional solvent-scouring method, and exhibits the following additional disadvantages.

(1) The alcohol and water cause the soapy substance to be eliminated to a great extent from the animal hair, and the resultant animal hair exhibits poor carding and spinning properties.

(2) In order to carry out this method, large sized equipment is necessary. This equipment is extremely expensive.

(3) It is difficult and complicated to control the number of operations and the quality of the resultant product.

(4) The yield of the scoured animal hair by this method is poor.

Another modified solvent-scouring method is disclosed in Japanese Patent Application Laid-Open (Kokai) No. 53-74178. In this method, the greasy wool is scoured with an organic solvent and, then, washed with hot water. However, this method is disadvantageous in the fatty substance in greasy animal hair and the soapy substance is excessively eliminated by the organic solvent and by the hot water, respectively. This feature results in additionally decreased softness, decreased adhering property of the hairs to each other and decreased spinning property of the hair.

Under the above-mentioned circumstances, none of the known methods for scouring the greasy animal hair could suggest the best way of scouring animal hair.

SUMMARY OF THE INVENTION

An object of the present invention is to provide a method for preparing a scoured animal hair material having excellent carding and spinning properties without causing any environmental pollution.

Another object of the present invention is to provide a method for preparing a scoured animal hair material having a desired soft and smooth touch at low cost.

The above-mentioned objects can be attained by the method of the present invention for preparing a scoured animal hair material in which the animal hair retains therein 1 to 3% by weight of a residual soapy substance and 0.3 to 5% by weight of a residual fatty substance, which method comprises opening a greasy animal hair material to cause it to be in the form of opened loose fibers having a density of from 0.007 to 0.04 g/cm$^3$, and; scouring said opened loose fibers with a scouring liquid comprising at least one organic solvent selected from the group consisting of 1,1,1-trichloroethane and methylene chloride, and 0.1 to 10%, based on the entire weight of said scouring liquid, or a raw animal hair grease which has been extracted from the same type of greasy animal hair as that to be scoured, while moving either one or both of said animal hair material and said scouring liquid in relation to each other at a relative speed of from 3 to 60 m/min.

DETAILED DESCRIPTION OF THE INVENTION

Figure 1:
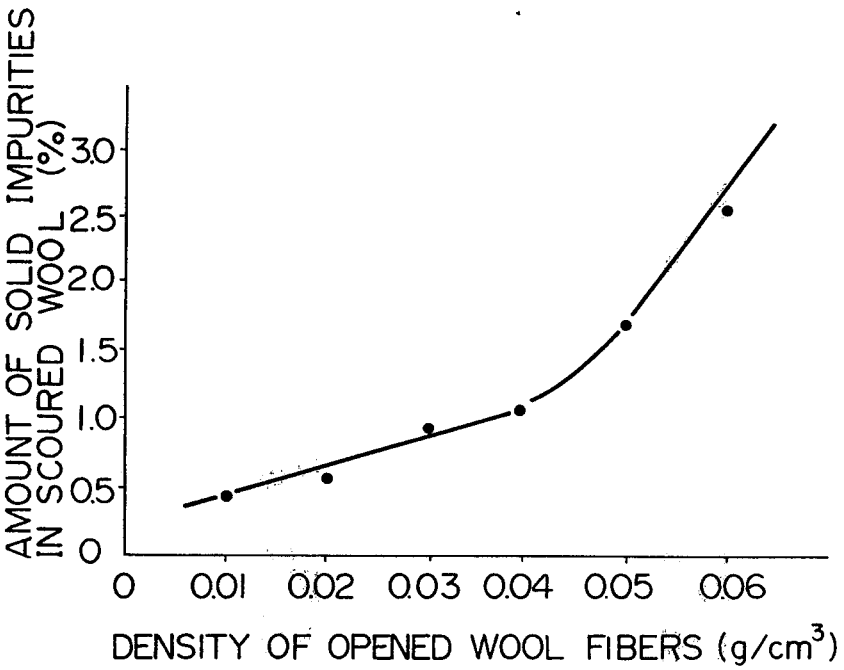
FIG. 1 is a graph showing a relationship between the density of opened greasy wool fibers to be scoured and the content of solid impurities retained in the resultant scoured wool fibers.

The method of the present invention is effective for preparing a scoured animal hair material in which the animal hair retains therein a residual soapy substance in a desirable amount of 1 to 3% by weight and a residual fatty substance in a desirable amount of 0.3 to 5% by weight which substances are evenly distributed on the animal hair surface. Also, the method of the present invention is effective for removing solid particles, such as sand, and water-soluble substances from the greasy animal hair material. Accordingly, the method of the present invention is significantly effective for preparing scoured animal hair material having a satisfactory brightness and excellent carding and spinning properties.

The residual soapy and fatty substances in the above-specified amounts are effective for protecting the animal hair not only from mechanical damage which will occur during various mechanical processings, for example, squeezing, tumble-drying, carding, spinning, winding and combing operations, but also, from thermal damage which will occur during the drying operation. Also, the specified amounts of the residual soapy and fatty substances are effective for obtaining a proper softness and a satisfactory touch of the resultant scoured animal hair.

When the contents of the residual soapy and fatty substances in the animal hair is less than 1% by weight and 0.3% by weight, respectively, the resultant scoured animal hair material exhibits a coarse touch, a poor carding property, and an unsatisfactory spinning and other mechanical processing properties. Also, when the content of the residual soapy and fatty substances in the animal hair is more than 3% by weight and 5% by weight, respectively, the resultant scoured animal hair material exhibits a greasy or sticky touch, poor carding, spinning and other mechanical processing properties.

The animal hair material to which the present invention can be applied is not limited to a specified animal hair material in a specified form, as long as the animal hair material can be scoured. For example, the animal hair material can be selected from wool materials, cashmere goat hair materials, alpaca hair materials, camel hair materials, angora rabbit hair materials, angora goat hair materials, sable hair materials, chinchilla hair materials, mink hair materials, fox hair materials, astrakhan hair materials, racoon dog hair materials, racoon hair materials, weasel hair materials, civet cat hair materials and lamb hair materials. Also, the animal hair material can be in the form a mass of loose hairs, web, sliver or top.

In the case of a wool material it is preferable that the content of the residual soapy substance in the scoured wool be in a range of from 1.2 to 2.5% by weight, and the content of the residual fatty substance be in a range of from 0.3 to 5.0% by weight. It is more preferable that the scoured wool retain therein 1.5 to 2.5% by weight of the residual soapy substance and 0.5 to 3% by weight of the residual fatty substance.

In the case of a cashmere goat hair material, it is preferable that the scoured cashmere goat hair retain therein 1.0 to 2.5% by weight of the residual soapy substance and 0.3 to 2.5% by weight of the residual fatty substance.

It is important to note that the scoured animal hair material of the present invention, in which the animal hair retains therein the specified amounts of the residual soapy and fatty substances, has never been obtained by the known prior arts. That is, the method of the present invention is quite new and inventive over the prior arts.

In the method of the present invention, it is essential that before or during the scouring operation, a greasy animal hair material be opened to an extent that the opened animal hair material is in the form of opened loose fibers having a density of from 0.007 to 0.04 g/cm$^3$. This opening procedure is effective for removing the solid impurity particles such as sand from the animal hair material. This opened loose animal hair can be obtained by subjecting a mass of the greasy animal hair to an opening apparatus, for example, an ordinary type or special pin roller type opening machine, in the ambient atmosphere and, then, suspending the opened greasy animal hairs in the scouring liquid. Otherwise, the opening operation may be carried out in the scouring liquid during the scouring operation. In the latter case, at least in the final stage of the scouring operation, the density of the opened loose animal hairs must be in the range of from 0.007 to 0.04 g/cm$^3$.

The density of the opened loose animal hair material of more than 0.04 g/cm$^3$ will cause the scoured animal hair material to contain an undesirably large amount of solid impurity particles.

This feature is clear from the following experiment. 200 g of Australian Merino greasy wool which was of a quality count of 64'S and had a content of 15.0% by weight of raw wool grease and a density of 0.30 was scoured with a scouring liquid consisting of 1,1,1-trichloroethane and 5%, based on the entire weight of the scouring liquid, of wool grease which had been extracted from the same type of wool as that described above, at a temperature of 22° C., for 8 minutes, by using a closed continuous scouring machine, while being opened. The scouring machine had four scouring vessels and was provided with a plurality of opening pin rollers located in the first vessel, a pair of squeezing rollers arranged in the fourth vessel and valves for discharging solid inorganic impurities, such as sand removed from the wool, located at the bottom of each vessel. In the scouring machine, the wool was opened to form loose fibers having a density of from 0.009 to 0.006 g/cm$^3$, and the opened wool moved at a speed of 40 m/min relative to the scouring liquid.

The relation between the density of the opened wool and the amount of the solid impurity particles in the scoured wool is shown in FIG. 1.

FIG. 1 clearly indicates that when the scouring operation is carried out at a density of more than 0.04 g/cm$^3$ of the wool, the content of the solid inorganic impurities in the resultant scoured wool becomes undesirably large.

When the density of the animal hair material to be subjected to the scouring operation is less than 0.007 g/cm$^3$, the scouring operation will cause the individual animal hairs to be entangled with each other. The entanglement of the animal hairs forms a number of naps and results in poor carding, combing and spinning properties of the scoured animal hair material.

Figure 2:
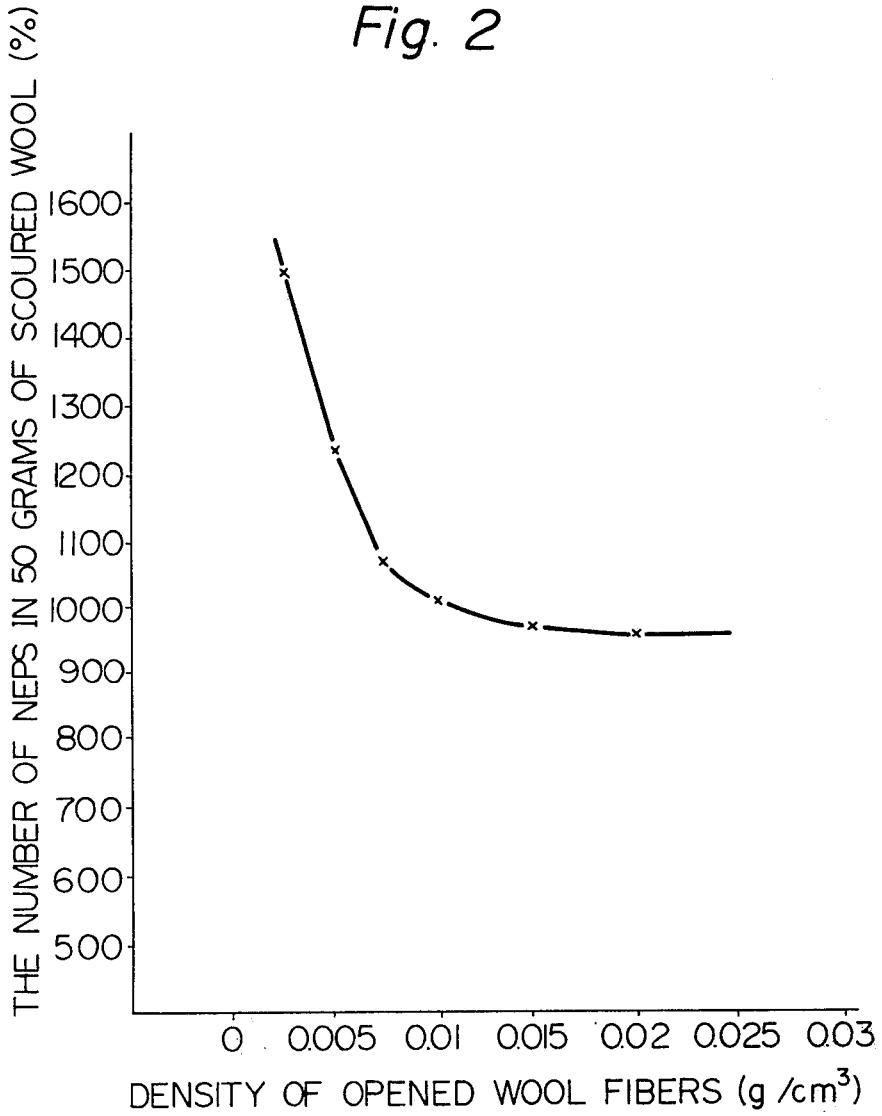
FIG. 2 is a graph showing the relationship between the density of opened greasy wool fibers to be scoured and the number of neps in 50 grams of the resultant scoured wool fibers.

In the above-mentioned experiment, the relationship between the density of the opened wool fibers and the number of neps contained in 50 g of the scoured wool is indicated in FIG. 2.

The number of the naps was determined in the following manner. A mass of scoured wool fibers was subjected to a gilling procedure by using an intersecting gill having a faller count number of 16, a pitch of pin of 2.15 mm, an effective length of pin of 20.1 mm and a working width of faller of 230 mm, at a faller speed of 4,87 m/min, at a draft of 6.15 and at a dropping count number of faller of 613 times/min. The above-mentioned gilling procedure was applied ten times to the scoured wool fiber mass. Thereafter, a sample consisting of 50 g of the gilled wool fiber was separated from the gilled wool fiber mass. The number of neps contained in the sample was counted.

FIG. 2 shows that the density of the opened wool of 0.007 g/cm$^3$ or more resulted in a small number of naps in the scoured wool.

Also, in the method of the present invention, it is essential that the scouring procedure is carried out by using a scouring liquid comprising at least one organic solvent selected from 1,1,1-trichloroethane and methylene chloride and 0.1 to 10%, based on the entire weight of the scouring liquid, of a raw animal hair grease which has been extracted from the same type of greasy animal hair as that to be scoured. The combination of the specified organic solvent with the specified amount of the raw animal hair grease is effective for causing the resulting scoured animal hair to retain therein 1 to 3% by weight of the residual soapy substance and 0.3 to 5% by weight of the residual fatty substance.

1,1,1-trichloroethane and methylene chloride can easily dissolve the fatty substance in the raw animal hair grease, but is not capable of dissolving the soapy substance. Also, 1,1,1-trichloroethane and methylene chloride are non-combustible, and exhibit a proper vapor pressure and a low toxicity for human body.

1,1,1-trichloroethane and methylene chloride have a specific gravity of 1.35 and 1.33, respectively, and a dielectric constant of from 6 to 9. The above-mentioned specific gravity and dielectric constant cause the organic solvents to be capable of easily eliminating the water-soluble substances and the solid impurity particles from the greasy animal hair material.

When the greasy animal hair material is scoured with an organic solvent, such as halogenated hydrocarbon, the solid impurity particles and the water-soluble substances are separated from the animal hair and, then, a portion of the separated solid impurity particles and/or water-soluble substances are adsorbed by the animal hair. The adsorbing rate of the separated solid impurity particles and/or water-soluble substances from the organic solvent used is variable depending on the type of the organic solvent. Particularly, the adsorbing rate is variable depending on the dielectric constant of the organic solvent used. That is, it was found by the inventors of the present invention that when an organic solvent having a dielectric constant of from 6 to 9 is used for scouring the greasy animal hair material, the resultant scoured animal hair material exhibited an excellent brightness. Also, it was found by the inventors of the present invention that the larger the dielectric constant of the organic solvent, the smaller the adsorbing rate of the separated solid impurity particles by the scoured animal hair material. This is because the organic solvent having an increased dielectric constant can stably hold the suspended solid impurity particles in the organic solvent.

However, a dielectric constant of the organic solvent of more than 9.0 causes the separated water-soluble substances in the organic solvent to be adsorbed by the scoured animal hair material at an increased adsorbing rate.

Accordingly, 1,1,1-trichloroethane and methylene chloride which have a dielectric constant ranging from 6 to 9 are very effective for preventing the adsorption of the separated solid impurity particles and water-soluble substances by the scoured animal hair material during the scouring procedure.

Usually, the animal hair has a specific gravity of about 1.3, and the solid impurity particles has a specific gravity of about 2.5. Accordingly, it is preferable that the scouring liquid has a specific gravity of slightly larger than 1.3, in order to allow the greasy or scoured animal hair material to stably float in the scouring liquid. Also, in order to allow the solid impurity particles to be easily separated from the greasy animal hair material, it is desirable that the specific gravity of the scouring liquid is significantly smaller than 2.5. Therefore, 1,1,1-trichloroethane with a specific gravity of 1.35 and methylene chloride with a specific gravity of 1.33 are most suitable as the scouring liquid for the greasy animal hair material having the solid impurity particles.

1,1,2-trichloroethylene has a dielectric constant within the range of 6 to 9 and a specific gravity of 1.44. However, 1,1,2-trichloroethylene is useless for the method of the present invention, because of its high level of toxicity which is harmful to human.

As described above, the specific scouring liquid of the present invention is highly effective for preventing the adsorption of the separated solid impurity particles and water-soluble substances by the scoured animal hair material and, therefore, for retaining specified amounts of the residual soapy and fatty substances in a uniform distribution on the animal hair. Accordingly, the scoured animal hair material can exhibit an enhanced brightness and spinning property. If the distribution of the residual soapy and fatty substances in the animal hair is uneven, the resultant scoured animal hair will exhibit poor mechanical processing properties and a poor touch.

When the organic solvent is hydrophilic, for example, an aliphatic alcohol, the resultant scoured animal hair exhibits an extremely poor content of the residual soapy substance therein. For instance, when a greasy wool is scoured with a scouring liquid consisting of ethyl alcohol at a liquor ratio of 1:100, at a temperature of 78° C., for 30 minutes, the resultant scoured wool retains therein the residual soapy substance in an amount of less than 1% by weight, for example, 0.8% by weight or less.

Also, even if the organic solvent not capable of dissolving the soapy substance is used, when the content of the animal hair grease in the scouring liquid is less than 0.1%, the resultant scoured animal hair material exhibits a very small content of the residual fatty substance retained therein. For instance, when greasy wool is scoured with a scouring liquid consisting of 1,1,1-trichloroethane and 0.04% of wool grease, the resultant scoured wool usually exhibits a content of less than 0.2% of the residual fatty substance.

Furthermore, if the content of the animal hair grease in the scouring liquid is larger than 10%, the resultant scoured animal hair material exhibits an excessively large content of the residual fatty substance.

Usually, it is preferable that the scouring operation be carried out at a temperature of from 0° to 100° C., more preferably, from 15° to 35° C.

The scouring liquid may contain a small amount of at least one another organic solvent, for example, lower aliphatic alcohol, such as ethyl alcohol, as long as the object of the present invention can be attained.

Furthermore, in the method of the present invention, it is essential that during the scouring operation, either one or both of the animal hair material and the scouring liquid move in relation to each other at a relative speed of from 3 to 60 m/min. That is, the animal hair material may move in the scouring liquid, or the scouring liquid may flow through the animal hair material. Otherwise, the scouring liquid may flow through the animal hair material while moving the animal hair material in the scouring liquid. It is important that the relative speed between the animal hair material and the scouring liquid is in the sample of from 3 to 60 m/min. A small relative speed of less than 3 m/min will result in an unsatisfactory separation of the solid impurity particles from the animal hair material. Also, a large relative speed of more than 60 m/min will cause the individual animal hairs to be undesirably entangled with each other so as to form a number of neps. The neps will cause the scoured animal hair material to exhibit poor carding, combing and spinning properties. That is, in the above-mentioned processes, a number of the individual animal hairs are broken and, therefore, the yield of the resultant product decreases.

The above-mentioned feature was supported by the following experiment.

Figure 3:
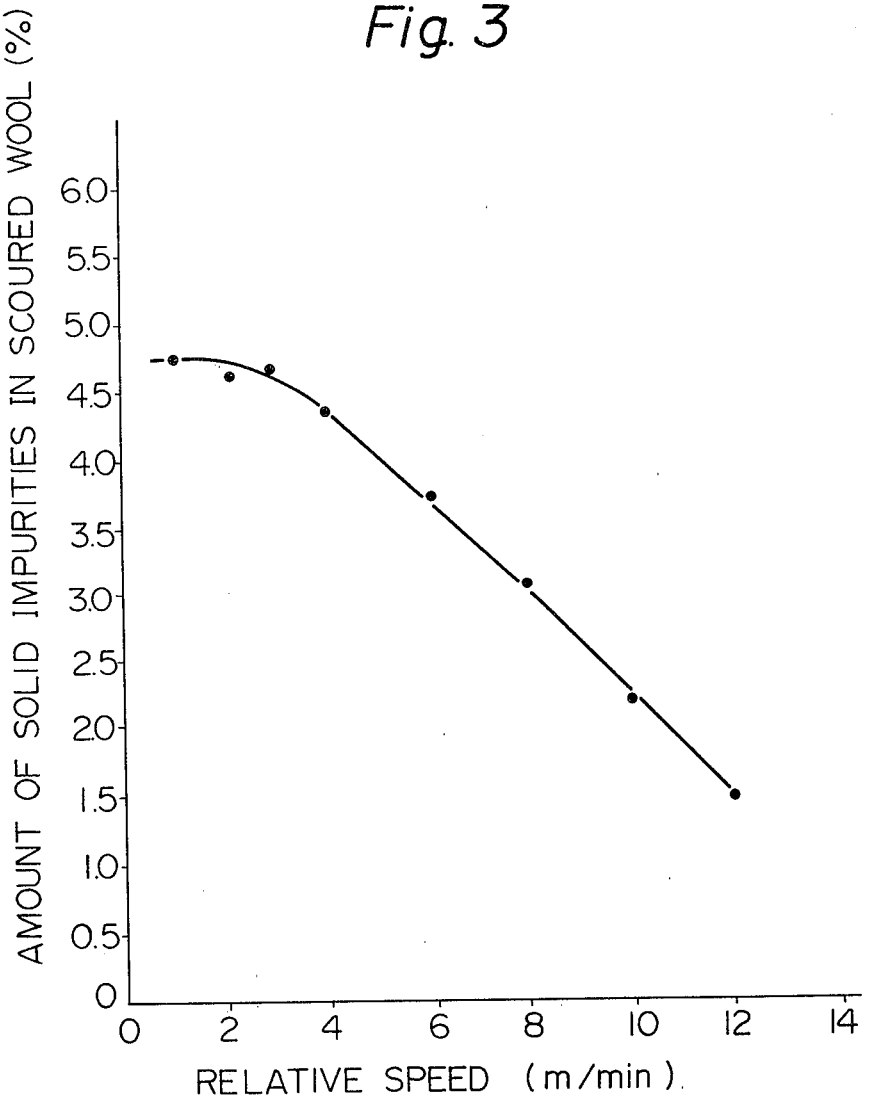
FIG. 3 is a graph showing the relationship between the relative speed of opened greasy wool fibers to the scouring liquid and the content of solid impurities in the resultant scoured wool fibers.
Figure 4:
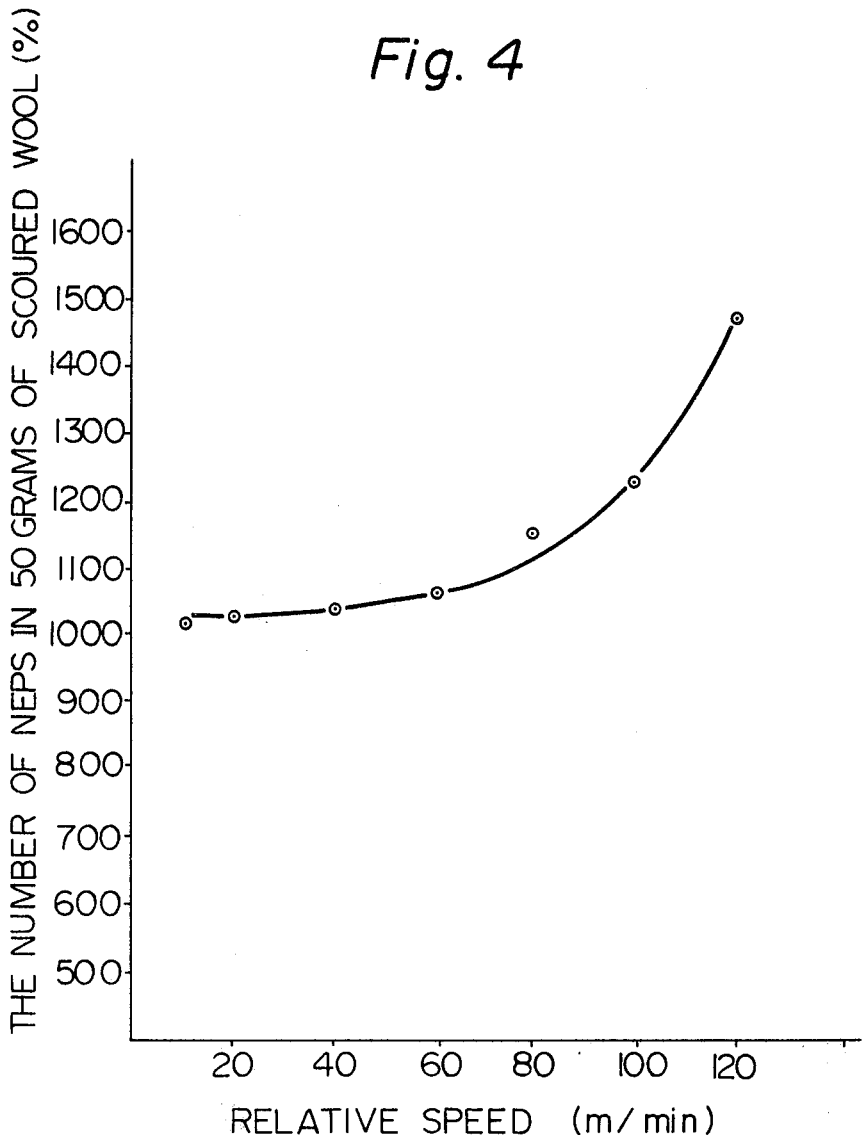
FIG. 4 is a graph showing the relationship between the relative speed of opened greasy wool fibers to the scouring liquid and the content of solid impurities in the resultant scoured wool fibers.

The same procedures as those in the afore-mentioned experiment were carried out, except that the density of the opened wool was 0.021 g/cm$^3$ and the relative speed was varied in the range of from 1 to 120 m/min. The relationship between the relative speed and the amount of solid impurity particles in the secured wool is indicated in FIG. 3. Also, the relationship between the relative speed and the number of naps contained in 50 g of the scoured wool is shown in FIG. 4. From FIG. 3, it is clear that when the relative speed is less than 3 m/min, the scoured wool contains a large amount of solid impurity particles. Also, FIG. 4 shows that when the relative speed is more than 60 m/min, the scoured wool contains a large number of naps.

After the completion of the scouring operation, the scoured animal hair material may be subjected to an additional procedure for additionally removing the solid impurity particles therefrom, if necessary. This removing procedure is carried out by a mechanical method, for example, by using an opening machine. The scouring method of the present invention is effective for promoting the removal of the solid impurity particles by the mechanical removing method. However, the conventional scouring methods exhibit an unsatisfactory efficiency in the removal of the solid impurity particles by the mechanical removing method, and result in breakage of a number of the individual animal hairs, and in a decreased yield of the resultant product.

Figure 5:
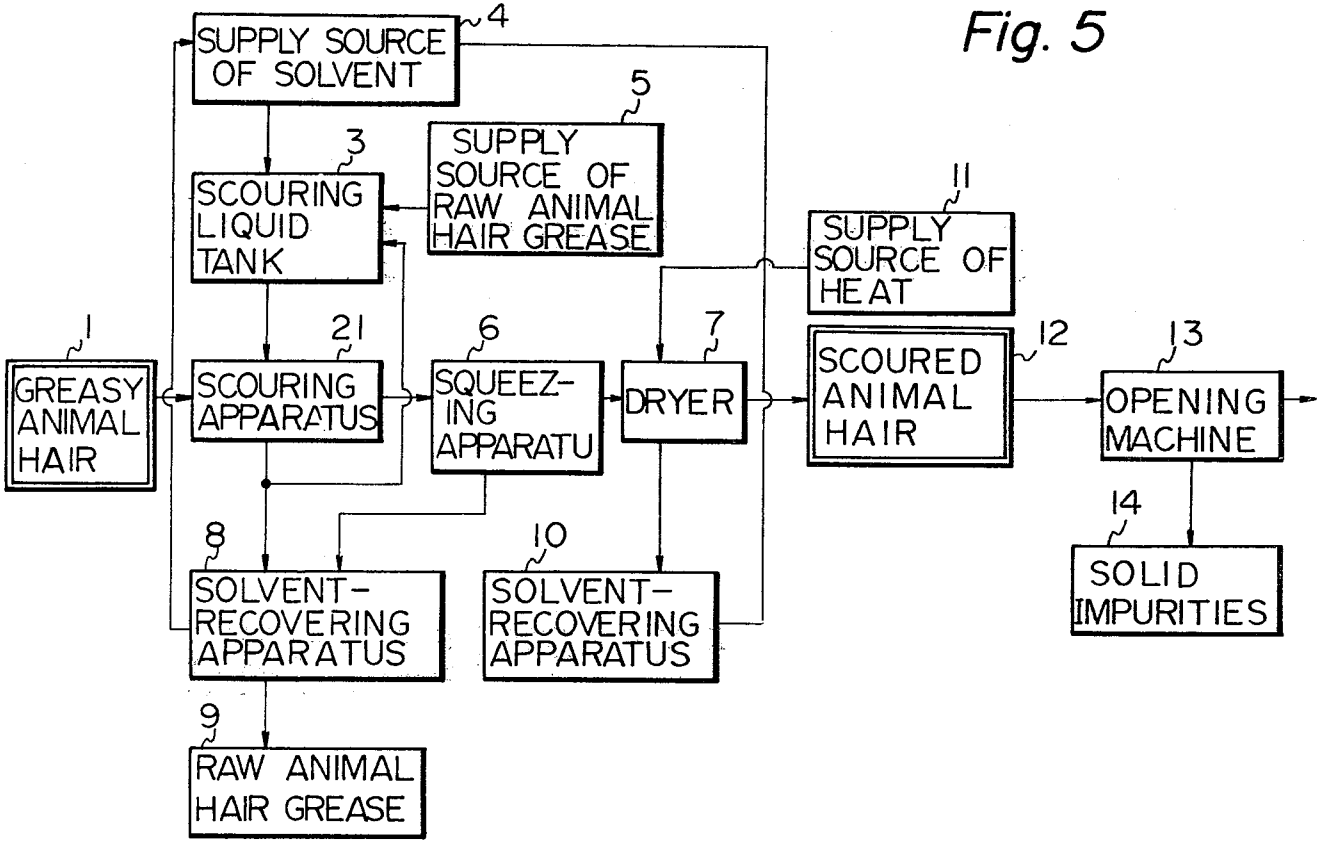
FIG. 5 is a flow sheet indicating a preferable practice of the method of the present invention.

A preferable practice of the method of the present invention will be illustrated by the following description with reference to FIG. 5.

Referring to FIG. 5, a greasy animal hair 1 is scoured in a scouring apparatus 2 with a scouring liquid supplied from a scouring liquid tank 3. The scouring liquid is prepared in the tank 3 by mixing a solvent, which has been supplied in a predetermined amount from a supply source 4 thereof, with a predetermined amount of a animal hair grease which has been supplied from a supply source 5 thereof.

The scoured animal hair is removed from the scouring apparatus 2 to a squeezing apparatus 6, and squeezed therein to a predetermined extent. The squeezing apparatus 6 may be at least one pair of nip rollers or a centrifugal separator. The squeezed animal hair is fed into a dryer 7 in which the solvent contained in the squeezed animal hair is evaporated by the heat supplied from a supply source 11 thereof.

A portion of the scouring liquid waste discharged from the scouring apparatus 2 may be recycled to the scouring liquid tank and mixed therein with an additional amount of fresh solvent, so as to adjust the concentration of the fatty substance in the scouring liquid.

The remaining portion of the scouring liquid waste discharged from the scouring apparatus and the scouring liquid waste discharged from the squeezing apparatus are collected. The collected waste is fed into a solvent-recovering apparatus 8, in which the solvent is evaporated and recovered from the liquid waste, and a residual animal hair grease is also recovered. The recovered solvent is recycled to the supply source 4 of the solvent. Also, a portion of the recovered animal hair grease is utilized for preparing the scouring liquid. The heat supply source 11 may be hot air, steam, hot water or high frequency waves.

The vapor generated in the dryer 7 is collected and recovered by a solvent-recovering apparatus 10. The recovered solvent is recycled to the supply source 4 of the solvent.

A scoured animal hair 12 is obtained from the dryer 7. If it is necessary, the scoured animal hair 12 is subjected to an opening machine 13, in which solid impurities 14 are removed therefrom.

In the practice of the method of the present invention, it is preferable that the scouring operation be carried out in a gas-tightly closed scouring apparatus. Also, it is preferable that the squeezing apparatus and the dryer be gas-tightly closed.

Figure 6:
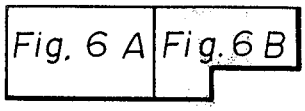
FIG. 6 is a flow sheet showing another preferable practice of the method of the present invention.
Figure 6A:
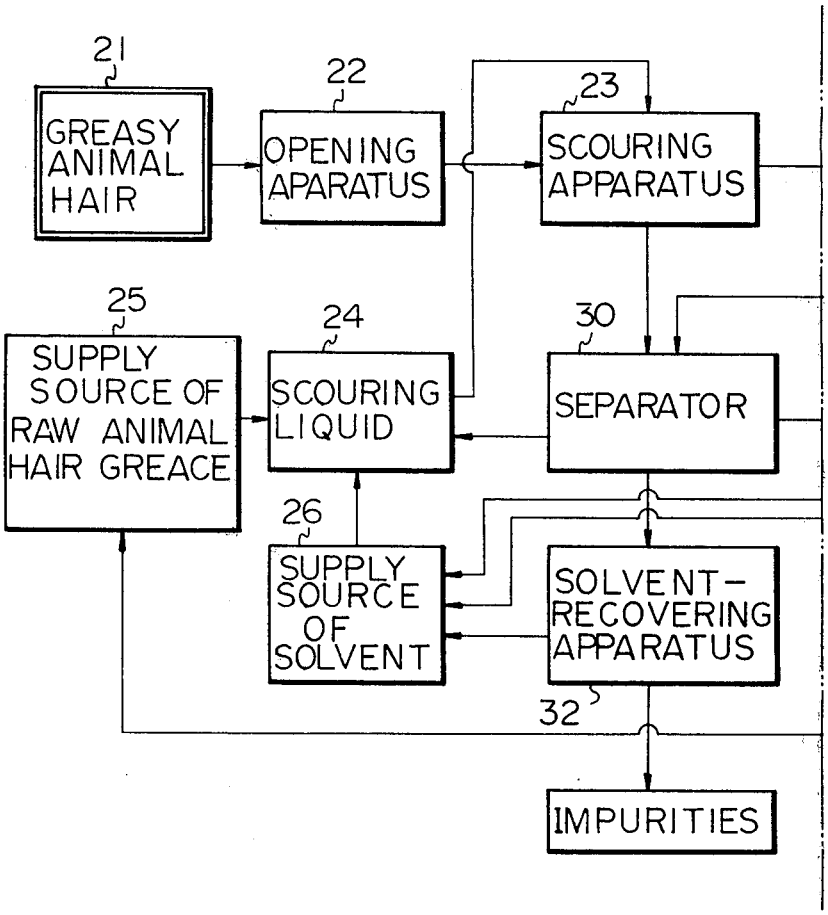
Figure 6B:
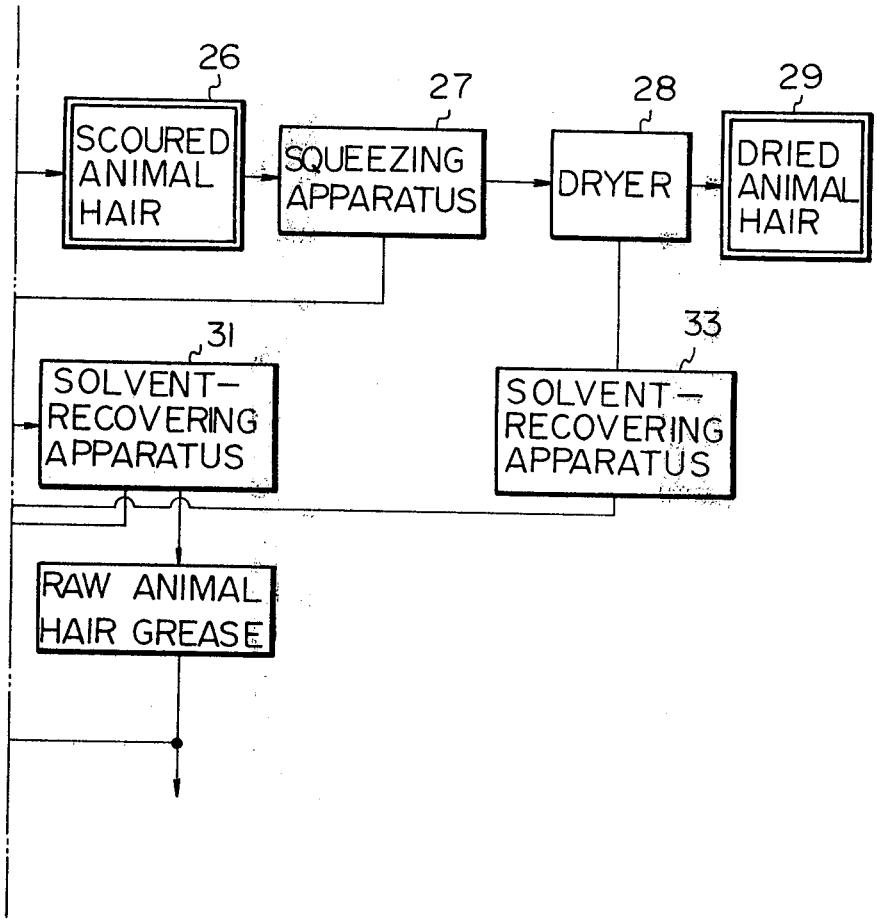

Another preferable practice of the method of the present invention is graphically indicated in FIG. 6.

Referring to FIG. 6, a greasy animal hair 21 is opened into the form of loose fibers by using an opening apparatus 22 and, then, fed into a scouring apparatus 23. A scouring liquid is prepared in a scouring liquid tank 24 by mixing a predetermined amount of a solvent supplied from a supply source 25 thereof with a predetermined amount of a raw animal hair grease supplied from a supply source 26 thereof.

The greasy animal hair is scoured in the scouring apparatus 23 with the scouring liquid supplied from the tank 24 thereof. A scoured animal hair 26 is removed from the scouring apparatus 23 and fed into a squeezing apparatus 27, in which the amount of the scouring liquid contained in the scoured animal hair is reduced to a predetermined extent. The squeezed animal hair is fed into a dryer 28 to evaporate the solvent therefrom and a dried animal hair 29 is obtained.

Scouring liquid waste discharged from the scouring apparatus 23 and the squeezing apparatus 27 is fed into a separator 30, in which the used scouring liquid containing the raw animal hair grease is separated from solid impurities.

A portion of the separated used scouring liquid is recycled to the scouring liquid tank 24 and mixed with an additional amount of fresh solvent supplied from the supply source 26 thereof, so as to adjust the concentration of the raw animal hair grease to a predetermined value. The remaining portion of the separated used scouring liquid is fed into a solvent-recovering apparatus 31 in which the solvent is separated from the raw animal hair grease. The solvent is recycled to the supply source 26 of solvent and the raw animal hair grease is recycled to the supply source 25 thereof, if necessary.

The solid impurities separated in the separator 30 are fed into a solvent-recovering apparatus 32 in which the solvent is evaporated from the solid impurities and, then, recycled into the supply source 26 of the solvent.

The solvent separated from the squeezed animal hair in the dryer 28 is recovered by a solvent-recovering apparatus 33 and, then, recycled into the supply source 26 of solvent.

The following specific examples are presented for the purpose of clarifying the present invention. However, it should be understood that these examples are intended only to illustrate the present invention and are not intended to limit the scope of the present invention in any way.

Referential Example

A greasy wool was treated with hot ethyl ether to extract therefrom a fatty substance. Thereafter, the wool was subjected to extraction with hot ethyl alcohol in a Soxhlet's extractor to extract a soapy substance.

It was found that the extract comprised 49.06% of entire fatty substances, 8.55% of a mixture of neutral fats and non-saponified substances which were soluble in a petroleum ether, and 43.10% of metal soaps, in terms of potassium soap, based on the dry weight of the extract. The metal soaps consisted of 2.59% of a metal fraction in terms of potassium and 40.51% of a fatty acid fraction, based on the dry weight of the extract. The fatty acid fraction exhibited a neutralization value (acid value) of 96.33 and an average molecular weight of 582.46. The metal fraction contained about 75% of potassium, about 25% of sodium and unmeasurable amounts of magnesium, calcium and aluminium.

Example 1

About 4000 Kg of Australian Merino greasy wool, with a quality count of 64'S, and had a content of 15.0% by weight of raw wool grease, were fed at a rate of 2 Kg/min into a five-vessel type scouring machine. The first vessel was provided with a plurality of opening pin rollers for opening the wool, and each vessel was provided with a pair of pinch rollers located in the exit portion thereof. The opened wool had a density of 0.03 g/cm$^3$. The delivery end of the scouring machine was connected to a three-suction drum type dryer. Each vessel contained 520 Kg of 1,1,1-trichloroethane at a temperature of 30° C. and was closed air tightly.

The scouring liquid was circulated at a relative speed of 10 m/min to the wool through the wool, while recovering a portion of the scouring liquid (9 Kg/min) from the first vessel, purifying the recovered scouring liquid, and feeding the purified scouring liquid to the fifth vessel. In this case, the concentration of the raw wool grease in the scouring liquid contained in the fifth vessel was maintained at a level of 0.2%. The scoured wool was withdrawn from the fifth vessel and squeezed by the pinch rolls under a pressure of 250 Kg/cm to the extent that the squeezed wool contained 70% of the scouring liquid based on the dry weight of the scoured wool. The squeezed wool was dried at a temperature of 80° C. for 3 minutes by using the three-suction drum type dryer.

The dried wool contained 0.5% by weight of the residual fatty substance, 2.1% by weight of the residual soapy substance and 2.1% by weight of solid impurity particles. Substantially no entanglement of the wool fibers with each other was found in the dried wool.

The dried wool was processed by an opening machine. The opened wool contained 0.6% by weight of the solid impurity particles.

The scoured wool was subjected to an ordinary top-making process. The resultant wool top exhibited such a quality that the average thickness of the wool fibers was 21.5 microns, the average length of the wool fibers was 85 mm, the coefficient of variation in the length was 33%. The top also exhibited an excellent brightness, softness and touch.

The top was subjected to a spinning process in which a wool yarn of a yarn count of 1/48's was produced at a spindle rotating number of 11,000/min. The spinning procedure was carried out without any difficulty and the resultant wool yarn exhibited a satisfactory quality.

Example 2

The same procedures as those mentioned in Example 1 were applied to 2000 Kg of Australian Camback greasy wool having a quality count of 58'S, and having a content of 14.05% of the wool grease, except for the following points. The concentration of the wool grease in the scouring liquid was 1.9%, the density of the opened wool was 0.038 g/cm$^3$ and the relative speed was 10 m/min.

After the scouring operation, the scoured wool in the vessel was compressed, so as to reduce the amount of the scouring liquid retained in the scoured wool to 96% based on the dry weight of the wool. The drying operation was carried out for at a temperature of 78° C. for 3 minutes. The scoured wool retained therein 2.5% by weight of the residual soapy substance, 2.8% by weight of the residual fatty substance and 2.5% by weight of solid particles. The opening portion applied to the scoured wool resulted in the removal of the solid impurity particles corresponding to 76% of the residual solid impurity particles in the scoured wool.

Example 3

The same procedures as those mentioned in Example 1 were applied to 2000 Kg of South African Merino greasy wool with a quality count of 64'S, and having a content of 14.5% of the wool grease, except for the following points. The concentration of the wool grease in the scouring liquid was 0.54%, the density of the opened wool was 0.025 g/cm$^3$ and the relative speed was 10 m/min.

After the scouring operation, the scoured wool in the vessel was compressed, so as to reduce the amount of the scouring liquid retained in the scoured wool to 86% based on the dry weight of the wool. The drying operation was carried out for at a temperature of 90° C. for 3 minutes. The scoured wool retained therein 2.5% by weight of the residual soapy substance, 0.7% by weight of the residual fatty substance and 3.1% by weight of solid particles. The opening operation applied to the scoured wool resulted in the removal of the solid impurity particles corresponding to 81% of the residual solid impurity particles in the scoured wool.

Example 4

The same procedures as those mentioned in Example 1 were applied to 2000 Kg of South American Cross Bred Merino greasy wool with a quality count of 64'S, and having a content of 11.3% of the wool grease, except for the following points. The concentration of the wool grease in the scouring liquid was 0.83%, the density of the opened wool was 0.032 g/cm$^3$ and the relative speed was 10 m/min.

After the scouring operation, the scoured wool in the vessel was compressed, so as to reduce the amount of the scouring liquid retained in the scoured wool to 120% based on the dry weight of the wool. The drying operation was carried out for at a temperature of 78° C. for 3 minutes. The scoured wool retained therein 2.3% by weight of the residual soapy substance, 1.5% by weight of the residual fatty substance and 2.3% by weight of solid particles. The opening operation applied to the scoured wool resulted in the removal of the solid impurity particles corresponding to 70% of the residual solid impurity particles in the scoured wool.

Example 5

The same procedures as those mentioned in Example 1 were applied to 2000 Kg of Australian Merino greasy wool with a quality count of 64'S, and having a content of 15% of the wool grease, except for the following points. The concentration of the wool grease in the scouring liquid was 2.5%, the density of the opened wool was 0.030 g/cm$^3$ and the relative speed was 10 m/min.

After the scouring operation, the scoured wool in the vessel was compressed, so as to reduce the amount of the scouring liquid retained in the scoured wool to 98% based on the dry weight of the wool. The drying operation was carried out for at a temperature of 80° C. for 3 minutes. The scoured wool retained therein 2.1% by weight of the residual soapy substance, 2.9% by weight of the residual fatty substance and 5.4% by weight of solid particles. The opening operation applied to the scoured wool resulted in the removal of the solid impurity particles corresponding to 81% of the residual solid impurity particles in the scoured wool.

Example 6

The same procedures as those mentioned in Example 1 were applied to 100 Kg of the same Australian Merino greasy wool as that described in Example 1, except for the following points. The concentration of the wool grease in the scouring liquid was 8.0%, and the relative speed was 10 m/min.

After the scouring operation, the scoured wool in the vessel was compressed, so as to reduce the amount of the scouring liquid retained in the scoured wool to 35% based on the dry weight of the wool. The scoured wool retained therein 2.3% by weight of the residual soapy substance, 2.8% by weight of the residual fatty substance and 3.0% by weight of solid particles. The opening operation applied to the scoured wool resulted in the removal of the solid impurity particles corresponding to 77% of the residual solid impurity particles in the scoured wool.

Example 7

200 Kg of the same greasy wool as that described in Example 1 were scoured with the same scouring liquid as that described in Example 1, at a temperature of 22° C., for 8 minutes, by using a closed continuous scouring machine, while the wool was being opened. The scouring machine had four scouring vessels and was provided with a plurality of opening pin rollers located in the first vessel, a pair of squeezing rollers arranged in the fourth vessel and valves for discharging solid inorganic impurities, such as sand removed from the wool, located at the bottom of each vessel. In the scouring machine, the wool was opened to form loose fibers having a density of 0.009 g/cm$^3$, and the opened wool moved at a speed of 4 m/min relative to the scouring liquid. Also, the content of the solid inorganic impurities in the fourth vessel was maintained at a level of 0.24% or less.

The scoured wool was squeezed by the squeezing rollers to such a degree that the amount of the scouring liquid retained in the squeezed wool corresponded to 100% of the dry weight of the wool. The squeezed wool was dried by using a closed hot air dryer for 4 minutes.

The resultant scoured wool retained therein 2.3% by weight of the residual soapy substance, 0.48% by weight of the residual fatty substance, and exhibited a satisfactory brightness and touch, and a UB solubility of 59.98%.

During the scouring procedure, the loss of short fibers was very small (Index=16) in comparison with the loss of short fibers in Comparative Example 6 (Index=100).

The scoured wool was subjected to an ordinary top-making process. The resultant wool top exhibited such a quality that the average thickness of the wool fibers was 21.54 microns, the average length of the wool fibers was 83.8 mm, the coefficient of variation in the length was 35.6%, the number of neps in 100 g of the wool top was 7.3 and the number of vegetable matters in 100 g of the wool top was 5.1. That is, the scoured wool exhibited an excellent top-making property and the wool top was obtained in a yield of 102.2% based on the yield of the wool top in Comparative Example 6. Also, the wool top exhibited a satisfactory spinning property. That is, the number of end breakages of yarns was 11 per 400 spindles per hour.

Example 8

The same procedures as those mentioned in Example 1 were applied to 400 Kg of the same greasy wool described in Example 1, except for the following points. The concentration of the wool grease in the scouring liquid was 0.2%, the density of the opened wool was 0.028 g/cm$^3$, and the relative speed was 10 m/min.

After the scouring operation, the scoured wool in the vessel was compressed, so as to reduce the amount of the scouring liquid retained in the scoured wool to 68% based on the dry weight of the wool. The drying operation was carried out for at a temperature of 85° C. for 3 minutes. The scoured wool retained therein 2.1% by weight of the residual soapy substance, 0.38% by weight of the residual fatty substance and 2.5% by weight of solid particles. The opening operation applied to the scoured wool resulted in the removal of the solid impurity particles corresponding to 68% of the residual solid impurity particles in the scoured wool.

Example 9

The same procedures as those described in Example 1 were carried out, except that 1,1,1-trichloroethane was replaced by methylene chloride. The resultant scoured wool contained 1.9% by weight of the residual soapy substance, 0.43% by weight of the residual fatty substance and 1.9% by weight of the solid impurity particles and exhibited an excellent brightness and touch.

Comparative Example 1

The same procedures as those described in Example 1 were carried out, except that 1,1,1-trichloroethane was replaced by trichloroethylene. The resultant scoured wool contained 2.1% by weight of the residual soapy substance, 0.56% by weight of the residual fatty substance and 4.1% by weight of the solid impurity particles and exhibited a satisfactory brightness and touch.

Comparative Example 2

The same procedures as those described in Example 1 were carried out, except that 1,1,1-trichloroethane was replaced by tetrachloroethylene. The resultant scoured wool contained 2.2% by weight of the residual soapy substance, 0.64% by weight of the residual fatty substance and 4.7% by weight of the solid impurity particles and exhibited a satisfactory brightness and touch.

Comparative Example 3

The same procedures as those described in Example 1 were carried out, except that 1,1,1-trichloroethane was replaced by n-hexane. The resultant scoured wool contained 2.3% by weight of the residual soapy substance, 0.58% by weight of the residual fatty substance and 5.3% by weight of the solid impurity particles and exhibited a satisfactory brightness and touch.

Comparative Example 4

The same procedures as those described in Example 1 were carried out, except that 1,1,1-trichloroethane was replaced by 1,1,2-trichloro-1,2,2-trifluoroethane. The resultant scoured wool contained 2.1% by weight of the residual soapy substance, 0.71% by weight of the residual fatty substance and 5.9% by weight of the solid impurity particles and exhibited a satisfactory brightness and touch.

Comparative Example 5

The same procedures as those described in Example 1 were carried out, except that 1,1,1-trichloroethane was replaced by methyl alcohol. The resultant scoured wool contained 0.2% by weight of the residual soapy substance, 0.59% by weight of the residual fatty substance and 5.4% by weight of the solid impurity particles and exhibited a satisfactory brightness and a poor touch.

Comparative Example 6

200 Kg of the same greasy wool as that described in Example 1 were scoured by using a 5 vessel-scouring machine. An aqueous scouring solution containing 0.1% by weight of a sodium soap and 0.1% by weight of sodium carbonate, was placed in the first, second and third vessels, and hot water was placed in the fourth and fifth vessels. The scouring operation was carried out at a temperature of 50° C., for 12 minutes, at a relative speed of 5 m/min of the wool to the scouring solution. In the scouring machine, the wool was opened to loose fibers having a density of 0.015 g/cm$^3$. The scoured wool was squeezed to an extent that the scouring solution remaining in the wool was in an amount corresponding to 65% of the dry weight of the wool and, then, dried at a temperature of 85° C., for 5 minutes, in a closed hot air dryer.

The resultant scoured wool retained therein 0.61% by weight of the residual fatty substance and 0.70% by weight of the residual soapy substance. The touch of the scoured wool was satisfactory, however, the brightness of the scoured wool was inferior to that of Example 8 and the UB solubility thereof was 53.5%.

The loss of short fibers in the scouring procedure was very large (Index=100).

The scoured wool was subjected to an ordinary top-making process. The resultant wool top exhibited such a quality that the average thickness of the wool fibers was 21.59 microns, the average length of the wool fibers was 77.4 mm, the coefficient of variation in the length was 36.6%, the number of neps in 100 g of the wool top was 13.4 and the number of vegetable substance particles in 100 g of the wool top was 11.3. That is, the wool top contained a large number of neps and vegetable matters, and was obtained in a yield of 100%. Also, the wool top exhibited a slightly poorer spinning property than that of Example 7. That is, the number of end breakages of yarns was 13 per 400 spindles per hour, at a spindle rotating number of 11,000/min.

Comparative Example 7

The same procedures as those described in Example 7 were carried out, except that no wool grease was used.

The resultant scoured wool retained therein 1.80% by weight of the residual soapy substance and 0.12% by weight of the residual fatty substance, and exhibited a satisfactory brightness, an undesirable coarse touch, and a UB solubility of 59.01%. The loss of short fibers in the scouring procedure was extremely small (Index=17).

The scoured wool was subject to an ordinary top-making process. The resultant wool top exhibited such a quality that the average thickness of the wool fibers was 21.52 microns, the average length of the wool fibers was 83.2 mm, the coefficient of variation in the length was 35.9%, the number of neps in 100 g of the wool top was 10.1 and the number of vegetable matters in 100 g of the wool top was 5.3. During the top-making process, static electricity was frequently generated on the wool fibers. The spinning property of the wool top was unsatisfactory. That is, the number of end breakages of yarns was 25 per 400 spindles per hour at a spindle rotating number of 10,000/min.

Comparative Example 8

The same procedures as those described in Example 1 were carried out, except that the wool was used in the amount of 300 kg, the density of the opened wool was 0.004 g/cm$^3$, the relative speed was 5 m/min, and the concentration of the wool grease in the scouring liquid was 0.35%.

After the scouring operation, the scoured wool in the vessel was compressed, so as to reduce the amount of the scouring liquid retained in the scoured wool to 98% based on the dry weight of the wool. The drying operation was carried out for at a temperature of 80° C. for 3 minutes. The scoured wool retained therein 2.2% by weight of the residual soapy substance, 0.78% by weight of the residual fatty substance and 2.2% by weight of solid particles. The opening operation applied to the scoured wool resulted in the removal of the solid impurity particles corresponding to 73% of the residual solid impurity particles in the scoured wool. The loss of short fibers in the scouring procedure was relatively large (Index=54).

The scoured wool was subjected to an ordinary top-making process. The resultant wool top exhibited such a quality that the average thickness of the wool fibers was 21.50 microns, the average length of the wool fibers was 83.7 mm, the coefficient of variation in the length was 35.7%, the number of neps in 100 g of the wool top was 9.5 and the number of vegetable matters in 100 g of the wool top was 6.4. That is, the scoured wool exhibited a satisfactory top-making property and the wool top was obtained in a yield of 101.6%. Also, the wool top exhibited a satisfactory spinning property. That is, the number of end breakages of yarns was 15 per 400 spindles per hour.

Example 10

The same scouring procedures as those described in Example 7 were applied to a Chinese cashmere goat hair having a content of 4.4% by weight of hair grease, except that the scouring operation was carried out by using a two vessel type scouring machine, at a temperature of from 20° to 22° C., for 2 minute, and the squeezing operation was carried out so as to retain therein the scouring liquid in an amount corresponding to from 70 to 90% of the weight of the wool.

The scoured cashmere goat hair retained 0.91% by weight of the residual soapy substance and 0.47% by weight of the residual fatty substance.

Example 11

The same procedures as those described in Example 10 were applied to a South African angora goat hair containing 5.4% by weight of hair grease.

The resultant scoured angora goat hair retained therein 1.20% by weight of the residual soapy substance and 0.44% by weight of the residual fatty substance.

Example 12

The same procedures as those described in Example 10 were applied to a Chinese camel hair containing 4.5% by weight of hair grease.

The resultant scoured camel hair retained therein 1.08% by weight of the residual soapy substance and 0.51% by weight of the residual fatty substance.

We claim:

1. A method for preparing a scoured animal hair material in which the animal hair retains therein 1 to 3% by weight of a residual soapy substance and 0.3 to 5.0% by weight of a residual fatty substance, which method comprises opening a greasy animal hair material to cause it to be in the form of opened loose fibers having a density of from 0.007 to 0.04 g/cm$^3$, and;

scouring said opened loose fibers with a scouring liquid comprising at least one organic solvent selected from the group consisting of 1,1,1-trichloroethane and methylene chloride, and 0.1 to 10%, based on the entire weight of said scouring liquid, of a raw animal hair grease which has been extracted from the same type of greasy animal hair as that to be scoured, while moving either one or both of said animal hair material and said scouring liquid in relation to each other at a relative speed of from 3 to 60 m/min.

2. A method as claimed in claim 1, wherein the amounts of said residual soapy and fatty substances are from 1.2 to 2.5% by weight and from 0.5 to 3% by weight, respectively.

3. A method as claimed in claim 1, wherein said animal hair is wool retaining therein 1.2 to 2.5% by weight of the residual soapy substance and 0.3 to 5% by weight of the residual fatty substance.

4. A method as claimed in claim 3, wherein said wool retains therein 1.5 to 2.5% by weight of the residual soapy substance and 0.3 to 3% by weight of the residual fatty substance.

5. A method as claimed in claim 1, wherein said animal hair is cashmere goat hair retaining therein 1.0 to 2.5% by weight of the residual soapy substance and 0.3 to 2.5% by weight of the residual fatty substance.

6. A method as claimed in claim 1, wherein said scouring operation is carried out at a temperature of 0° to 100° C.

7. A method as claimed in claim 1, wherein after said scouring operation is completed, said scouring liquid is removed from the resultant scoured animal hair material to an extent that said scoured animal hair material retains therein said scouring liquid in an amount corresponding to 20 to 200% of the weight of said scoured animal hair material, and the resultant scoured hair material is dried while recovering said organic solvent.

8. A method as claimed in claim 7, wherein said drying operation is carried out at a temperature of 30° to 160° C.

* * * * *